United States Patent [19]

Moran

[11] 4,332,345

[45] Jun. 1, 1982

[54] CONTAINER WITH INFOLDED BOTTOM CLOSURE

[75] Inventor: John P. Moran, Pleasant Ridge, Mich.

[73] Assignee: Ex-Cell-O Corporation, Troy, Mich.

[21] Appl. No.: 132,014

[22] Filed: Mar. 20, 1980

[51] Int. Cl.[3] ..... B65D 5/08

[52] U.S. Cl. ..... 229/37 R; 229/17 R

[58] Field of Search ..... 229/17 G, 37 R, 17 R

[56] References Cited

U.S. PATENT DOCUMENTS

| | | | |
|---|---|---|---|
| 2,390,909 | 12/1945 | Zinn, Jr. | 229/17 G X |
| 2,962,202 | 11/1960 | Hansen | 229/37 R |
| 3,120,335 | 2/1964 | Egleston et al. | 229/17 G X |
| 3,270,940 | 9/1966 | Egleston et al. | 229/48 R X |
| 3,291,369 | 12/1966 | Crawford | 229/17 G X |
| 3,332,602 | 7/1967 | Flax | 229/37 R |
| 3,334,802 | 8/1967 | Gooding . | |
| 3,365,115 | 1/1968 | Pike . | |
| 3,412,922 | 11/1968 | Miller et al. | 229/37 R |
| 3,412,923 | 11/1968 | Ihde et al. | 229/37 R |
| 3,474,951 | 10/1969 | Egleston et al. | 229/37 R |
| 3,581,977 | 6/1971 | Kirsky | 229/37 R |
| 4,124,159 | 11/1978 | Schwartzkopf | 229/17 G |
| 4,192,446 | 3/1980 | Naito | 229/17 G X |

FOREIGN PATENT DOCUMENTS

| | | | |
|---|---|---|---|
| 1193790 | 5/1965 | Fed. Rep. of Germany | 229/DIG. 9 |
| 630622 | 10/1949 | United Kingdom | 229/38 |

*Primary Examiner*—Herbert F. Ross

*Attorney, Agent, or Firm*—John P. Moran

[57] ABSTRACT

This disclosure illustrates and describes a bottom closure structure for a liquid carrying, thermoplastic coated paperboard carton or container wherein the overlapped and sealed areas are formed so as to extend in an "X"-shaped configuration across the bottom, with minimal raw edge exposure on the inside. The shapes of the four main bottom panels of the blank from which the carton is formed are such that they accommodate interdigital nesting or overlapping with respect to the bottom section of an adjacent blank prior to the cutting operation on a paperboard roll, thereby resulting in a narrower roll and, hence, a substantial paperboard savings.

7 Claims, 8 Drawing Figures

CONTAINER WITH INFOLDED BOTTOM CLOSURE

TECHNICAL FIELD

This invention relates generally to liquid carrying paperboard cartons or containers and, more particularly, to a novel fold-in bottom closure for such containers.

BACKGROUND ART

It is well known that paperboard used for milk and juice containers can be economically coated with heat and pressure sensitive thermoplastic substances. Such substances must be inert to the substances to be packaged, strong and durable, inexpensive, and easy to apply in sheet form onto the paperboard. One example of a suitable thermoplastic substance, useful for packaging dairy products, is polyethylene.

The paperboard stock for forming the containers is initially supplied in the form of rolls. As the stock is produced it is coated on both sides with layers of polyethylene of predetermined thicknesses. Blanks are then cut from the thus treated paperboard roll, and scored so as to be adaptable to being folded into a tubular shape with readily foldable and sealable leak-proof top and bottom closures. Generally, it has been desirable for the finished bottom end closure to contain at least three plies of stock at each bottom corner area, with a minimal length of raw edge exposed to the interior of the container and, hence, to the contents thereof.

A very satisfactory and widely used container and infolded bottom closure is that shown and described in Egleston et al. U.S. Pat. No. 3,120,335.

In view of the fact that a considerable volume of thermoplastic coated paperboard is used for the packaging of milk and juices on today's market throughout the world, it is desirable to save as much paperboard as possible while maintaining the current high standards for efficiently manufacturing a high quality, leak-proof, sanitary container.

DISCLOSURE OF THE INVENTION

Accordingly, a general object of the invention is to provide a liquid carrying, heat sealable container having an improved bottom end closure which remains leak-proof while containing infolded panels having substantially less overlapping paperboard than has heretofor been the case.

Another object of the invention is to provide a container blank wherein the four panels thereof which serve to make up the bottom end closure are shaped such that the bottom end closure panels of the adjacent blank are internested therewith, thereby making possible the use of a narrower roll of paperboard for each two rows of blanks.

A further object of the invention is to provide an improved paperboard-saving, bottom end closure which is adaptable to conventional tucking and tacking apparatus on current forming, filling and sealing machines with minimal modification of the latter.

Still another object of the invention is to provide such an improved bottom end closure which is adaptable, after being folded flat, to being sealed by conventional gas heat, electrical, or ultrasonic methods.

These and other objects and advantages of the invention will be apparent when reference is made to the following description and accompanying drawings.

BEST MODE OF CARRYING OUT THE INVENTION

Figure 1:
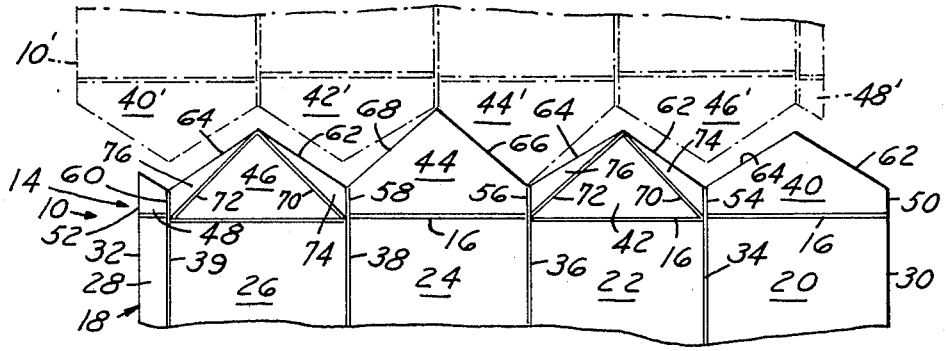
FIG. 1 is a layout view of a portion of a blank from which the bottom closure of the invention is formed, showing the outside surface thereof, along with illustrating the internested position of an adjacent blank in phantom prior to being cut from a paperboard roll.
Figure 2:
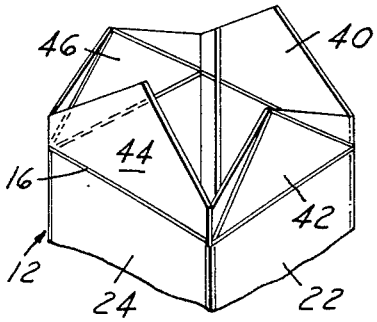
FIGS. 2, 3 and 4 are fragmentary perspective views illustrating sequentially various steps in forming the bottom closure.
Figure 3:
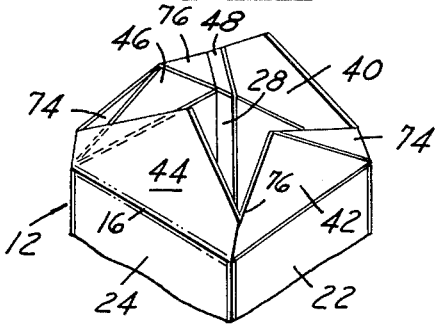
Figure 4:
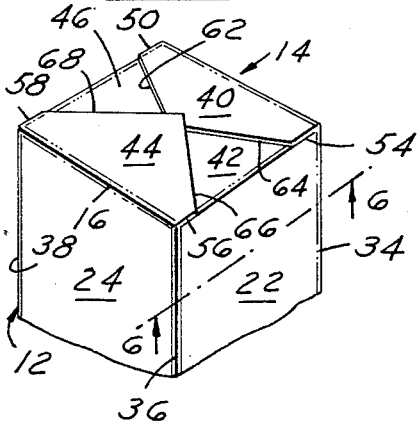

Referring now to the drawings in greater detail, FIG. 1 illustrates a fragmentary blank 10 suitable for being formed into a tubular body 12, as shown in FIGS. 2–4. One end of the body 12 is provided with a suitable top end closure (not shown), such as the familiar gable top configuration of Egleston et al. U.S. Pat. No. 3,270,940, incorporated herein by reference.

Figure 5:
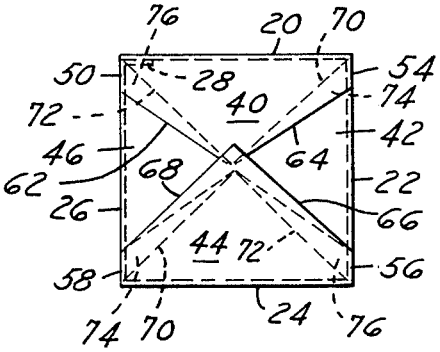
FIG. 5 is an outside view of the container bottom.

The flat bottom end closure 14 of FIGS. 4 and 5 is shaped from the blank 10 of FIG. 1 which is separated into two groups of panels by a staggered score line 16. The purpose of the score line 16 being staggered in the form shown is to accommodate the thickness of the sheet material as it is bent along the score lines when the closure is erected and thus prevent crowding of the material at the various corner junctions of the score lines. This not only enhances the strength and appearance of the finished container but facilitates its erection and closure by automatic machinery. The material above the score line 16 in FIG. 1 is the bottom closure group 14 while the material shown below the line 16 is the body group 18. The latter comprises four side panels 20, 22, 24 and 26 and a side seam panel or flap 28. The body group is defined on the sides by edges 30 and 32, with the panels being separated by score lines 34, 36, 38 and 39.

The bottom closure group 14 comprises closure panels 40, 42, 44 and 46 adjacent the body panels 20, 22, 24 and 26, respectively, and an extension 48 of the side seam flap 28. The closure panels 40, 42 and 46 encompass the same shapes and overall areas, while the panel 44 is larger in area and height. Each of the panels 40, 42 and 46 is gable-shaped, having short vertical sides and sloped outer edges terminating at an apex whose height is one half the width of a body panel. The short vertical sides constitute edges 50 and 52, and score lines 54, 56, 58 and 60 between panels 40/42, 42/44, 44/46 and 46/48, respectively. Each of the panels 40, 42 and 46 include identical sloped edges 62 and 64, while the panel 44 includes steeper sloped edges 66 and 68 terminating at an apex whose height is a predetermined amount greater than one half the width of a body panel.

The two oppositely disposed end panels 42 and 46, which are joined to opposite sides of the largest end panel 44, are each divided by a pair of diagonal score lines 70 and 72, forming opposite outer triangles 74 and 76 with the sloped edges 62 and 64, respectively. One diagonal score line 70 extends from the juncture of the score lines 16, 34 and 54 to the apex of the panel 42, while the other diagonal score line 70 extends from the juncture of the score lines 16, 38 and 58 to the apex of the panel 46, respectively. One diagonal score line 72 extends from the juncture of the score lines 16, 36 and 56 to the apex of the panel 42, while the other diagonal score line 72 extends from the juncture of the score lines 16, 39 and 60 to the apex of the panel 46, respectively.

At this point, it should be noted that, inasmuch as the blanks 10 are cut from a wide roll of paperboard, an adjacent blank 10' (FIG. 1) can have its bottom end closure panels 40', 42', 44', 46' and 48' internested with the adjacent closure panels 48, 46, 44, 42 and 40, respectively. Such internesting saves a width of paper equal to the vertical height of the sloped edges 66 and 68 of the largest closure panel 44, represented in FIG. 1 as "A". For those applications wherein the roll of paperboard is wide enough for four blanks abreast, it is apparent that the width of paperboard saved would be twice the height "A".

To construct the container bottom closure as shown in FIG. 4, a flat side seamed blank is first formed by folding the blank 10 upon itself and sealing the side seam flap 28 and its extension 48 to the inside faces of panels 20 and 40, respectively, using any of the well-known plastic sealing methods such as heat, sound or light. The folded blank is next formed into the tubular body 12 (FIG. 2) on a mandrel (not shown), with the bottom closure panels extending outwardly from the face of the mandrel. Following this, the container bottom is infolded (FIG. 3) and sealed (FIGS. 4 and 5).

As indicated in FIG. 3, the inner triangular portions of the panels 42 and 46 are urged toward each other, with the outer triangular portions 74 and 76 thereof caused to fold-back outwardly about the score lines 70 and 72 and toward the inner triangular portions. Upon completion of the folding process, the inner triangular portions 74 and 76 are confined between the inside panels 42/46 and the outside panels 40/44, as shown in FIG. 5, with the longer panel 44 overlapping the end portion of the opposite outside panel 40. The resultant flat end configuration is sealed by any suitable method, such as by gas heat or ultrasonically, in a substantially "X" shaped pattern, i.e., along the four diagonal, triple layered segments extending from each corner to the center of the bottom closure.

Figure 6:
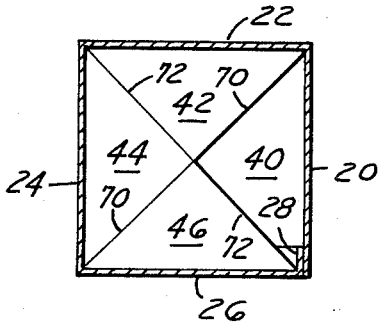
FIG. 6 is a cross sectional view taken along the plane of the line 6—6 of FIG. 4, and showing an inside view of the container bottom.

In FIG. 6, it may be noted that, on the inside of the container, the apices of the panels 42 and 46 meet at the center of the container, while the apex of the panel 40 lies directly underneath. Hence, no raw edges are exposed on the inside of the bottom end closures.

Figure 7:
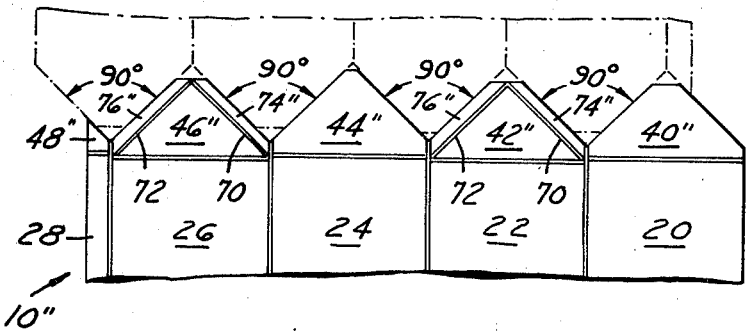
FIG. 7 is a layout view of a portion of a blank from which an alternate bottom closure of the invention is formed, showing the outside surface thereof, along with illustrating the internested position of an adjacent blank in phantom prior to being cut from a paperboard roll.

Referring now to FIG. 7, it may be noted that the body panels 20, 22, 24, 26 and 28 of the blank 10'' are identical to those of the FIG. 1 embodiment, while the bottom end closure panels 40'', 42'', 44'', 46'' and 48'' are formed so as to have 90° angles between adjacent sloped edges, terminating at a horizontal edge located adjacent the apex formed by the diagonal score lines 70 and 72, and said diagonal score lines forming a right triangle with the horizontal score line 16. As such, cutting a roll of paperboard to form the sloped edges of the bottom end closure panels 40'', 42'', 44'', 46'' and 48'' will also serve to form the sloped edges of the bottom end closure panels of the adjacent blank, shown in phantom, resulting in minimal scrap therebetween. The panels 43'' and 46'' each have a height equal to approximately one-half the width of a side panel.

Figure 8:
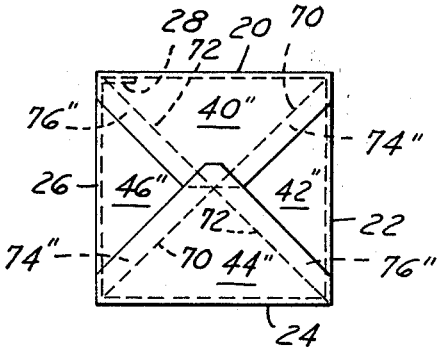
FIG. 8 is an outside view of the container bottom of FIG. 7.

As shown in FIG. 8, the blank 10'' of the FIG. 7 embodiment is formed into a bottom end closure wherein the inner triangular portions of the panels 42'' and 46'' are first urged toward each other, with the outer trapezoidal portions 74'' and 76'' formed by the diagonal score lines 70 and 72 being caused to fold outwardly about the score lines 70 and 72 and onto the triangular portions. As such, the outer trapezoidal portions are confined between the inner triangular portions and the adjacent edge portions of the respective panels 40'' and 44''. The longer panel 44'' extends past the end portion of the oppositely disposed panel 40''. The resultant flat end configuration is sealed in a substantially "X" shaped pattern, as was the case with the FIG. 5 embodiment, i.e., along the four diagonal, triple layered segments extending from each corner to the center of the bottom closure.

In this embodiment, provision may be made for obtaining an exceptionally tight seal of the bottom closure when finally completed. This is accomplished by constructing the laterally cut edges of the trapezoidal portions 74'' and 76'' such that they enter into positive abutting engagement with each other prior to completion of the bottom closure. More specifically, the panels 42'' and 46'' may be so proportioned that the combined length thereof is slightly greater than the width of each side panel measured along the score line 16. Thus, the paperboard is "crowded" together in the closing operation, thereby greatly enhancing the tightness of the bottom seal.

INDUSTRIAL APPLICABILITY

It should be apparent that the invention provides an efficient and readily machine formable bottom end closure for a liquid carrying paperboard container, which is also economical to produce insofar as the forming of the blanks from a paperboard roll is concerned, as compared to the conventional blanks heretofor in popular use.

It should also be apparent that the container formed from the improved bottom closure need not expose any internal raw edges in the center or cross-over portion of the bottom closure.

While but two embodiments of the invention have been shown and described, other modifications thereof are possible.

The embodiments of the invention in which an exclusive property or privilege is claimed are defined as follows:

1. A container of paperboard or the like having an overall surface of thermoplastic material that becomes adhesive when subjected to heat, said container comprising four substantially equal width side panels, first and second pairs of opposed bottom closure panels alternately connected to said side panels as extensions thereof and connected one to the other by score lines along their sides for a (predetermined) partial portion of their heights, each bottom closure panel having free cut edges extending at (a predetermined) an angle intermediate the end of said score lines and the centerline of said bottom closure panel and terminating at a point such that the heights of two oppositely disposed panels are each equal to approximately one half the width of a side panel, and the height of at least one other bottom closure panel is (a predetermined amount) greater than one half the width of a side panel, said two oppositely disposed panels each including a pair of diagonal score lines for forming triangular panels whose apices touch one another on the inside of the container, at least a portion of each of said free cut edges being substantially parallel to each respective adjacent diagonal score line, and the end portion of said one other bottom closure panel overlapping the end portion of the fourth bottom closure panel on the outside of the container.

2. The container described in claim 1, wherein the terminal edge of said fourth bottom closure panel is sealed directly beneath said adjacent apices of said triangular panels, as viewed from the inside of the container, thereby eliminating raw edges from being exposed on the inside of the container.

3. A container of paperboard or the like having an overall surface of thermoplastic material that becomes adhesive when subjected to heat, said container comprising four substantially equal width side panels, first and second pairs of opposed bottom closure panels alternately connected to said side panels as extensions thereof, said first pair of bottom closure panels being triangular in shape and infolded from oppositely disposed side panels, two pairs of fold-back panels each pair of which is connected to a respective one of said triangular bottom closure panels and to respective ones of said second pair of opposed bottom closure panels so as to be sealed in substantially an "X" shape between said first and second pairs of bottom closure panels, wherein said sealed "X" shape is only three layers thick while the four panel portions between adjacent three layer thick sealed sections are each only one layer thick.

4. The container described in claim 3, wherein said fold-back panels are at least three-sided in shape.

5. The container described in claim 3, wherein said fold-back panels are at least four-sided in shape.

6. A thermoplastic covered paperboard blank for a container, said blank comprising four side panels, first and second pairs of bottom closure panels alternately connected by respective horizontal score lines to the bottom edges of said four side panels as extensions thereof, a pair of diagonal score lines formed on each of said first pair of bottom closure panels forming right triangles with said respective horizontal score lines, a first pair of free cut edges formed on each of said first pair of bottom closure panels substantially parallel to said respective pairs of diagonal score lines, and a second pair of free cut edges formed on each of said second pair of bottom closure panels at substantially right angles with respect to the adjacent first free cut edges.

7. The blank described in claim 6, wherein said pair of diagonal score lines formed on each of said one pair of bottom closure panels form trapezoidal panels with respective side score lines and said first pair of free cut edges.

* * * * *

UNITED STATES PATENT OFFICE

CERTIFICATE OF CORRECTION

Patent No. 4,332,345 Dated June 1, 1982

Inventor(s) John P. Moran

It is certified that error appears in the above-identified patent and that said Letters Patent are hereby corrected as shown below:

Column 4, line 64, delete "(predetermined)".

" ", line 66, delete "(a predetermined)".

Column 5, line 4, delete "(a predetermined amount)".

Signed and Sealed this

*Twenty-sixth* Day of *April 1983*

[SEAL]

*Attest:*

GERALD J. MOSSINGHOFF

*Attesting Officer*

*Commissioner of Patents and Trademarks*